US011280580B2

(12) United States Patent
Liptak et al.

(10) Patent No.: US 11,280,580 B2
(45) Date of Patent: Mar. 22, 2022

(54) FIREARM STOCK OR ARM BRACE

(71) Applicant: Magpul Industries Corp., Austin, TX (US)

(72) Inventors: Duane Liptak, Wimberly, TX (US); Timothy Eric Roberts, Broomfield, CO (US)

(73) Assignee: Magpul Industries Corp., Austin, TX (US)

( * ) Notice: Subject to any disclaimer, the term of this patent is extended or adjusted under 35 U.S.C. 154(b) by 0 days.

(21) Appl. No.: 17/148,280

(22) Filed: Jan. 13, 2021

(65) Prior Publication Data

US 2021/0239423 A1 Aug. 5, 2021

Related U.S. Application Data

(60) Provisional application No. 62/960,620, filed on Jan. 13, 2020.

(51) Int. Cl.
*F41C 23/12* (2006.01)
*F41C 23/02* (2006.01)
*F41C 23/14* (2006.01)

(52) U.S. Cl.
CPC ..... *F41C 23/12* (2013.01); *F41C 23/02* (2013.01); *F41C 23/14* (2013.01)

(58) Field of Classification Search
CPC ..... F41C 23/12; F41C 23/14
See application file for complete search history.

(56) References Cited

U.S. PATENT DOCUMENTS 3,348,328 A * 10/1967 Roy ..... F41C 23/14 42/73
7,823,313 B2 * 11/2010 Faifer ..... F41C 23/06 42/74
7,849,626 B2 * 12/2010 Fluhr ..... F41C 23/04 42/73
D6,311,122 1/2011 Domagtoy
(Continued)

FOREIGN PATENT DOCUMENTS

DE 202019001332 U1 5/2019

OTHER PUBLICATIONS

Flux Defense, "Flux Brace", Known to exist as early as Sep. 25, 2019, p. 4, Publisher: Retrieved from https://www.fluxdefense.com/.
(Continued)

*Primary Examiner* — Joshua T Semick
(74) *Attorney, Agent, or Firm* — Neugeboren O'Dowd PC

(57) ABSTRACT

This disclosure describes a firearm stock or arm brace with an adjustable length of pull. The stock or arm brace can include a body and lower stock, where the body includes a buffer tube receiving aperture and the lower stock includes a hollow cavity with a plunger and two concentric springs therein. One or more buttons can be affixed to sides of the plunger in the hollow cavity that can be used to depress the plunger against the force of one or both of the springs. One of the two springs may be shorter than the other and have a greater spring constant than the longer spring. Depressing the plunger against the taller spring may allow a user to adjust the length of pull while greater pressure and engagement of the second spring allows the stock or arm brace to be removed from a buffer tube or receiver extension.

18 Claims, 14 Drawing Sheets

(56) References Cited

U.S. PATENT DOCUMENTS

| | | | | |
|---|---|---|---|---|
| 8,127,483 | B2 * | 3/2012 | Kincel | F41C 23/14 42/73 |
| 8,317,242 | B2 | 11/2012 | Yu | |
| 8,341,868 | B2 * | 1/2013 | Zusman | F41C 23/22 42/73 |
| 8,448,366 | B2 | 5/2013 | Faifer | |
| 8,677,669 | B1 | 3/2014 | Vesligaj | |
| D706,896 | S | 6/2014 | Bosco | |
| 8,776,421 | B1 | 7/2014 | Vesligaj | |
| 8,869,444 | B2 | 10/2014 | Bosco | |
| 8,910,407 | B2 | 12/2014 | Singh | |
| 8,978,285 | B1 * | 3/2015 | Burke | F41C 23/20 42/73 |
| D728,724 | S | 5/2015 | Bosco | |
| 9,188,406 | B2 | 11/2015 | DenBleyker | |
| 9,261,324 | B1 * | 2/2016 | Liang | F41C 23/04 |
| 9,297,613 | B2 | 3/2016 | Maentymaa | |
| 9,354,021 | B2 | 5/2016 | Bosco | |
| 9,423,207 | B2 | 8/2016 | Hunkley | |
| D771,765 | S | 11/2016 | Ewer | |
| 9,631,893 | B2 | 4/2017 | Gilmer | |
| 9,651,336 | B2 | 5/2017 | Ringgenberg et al. | |
| 9,664,477 | B1 | 5/2017 | Reavis, III | |
| 9,696,110 | B2 | 7/2017 | Hollis | |
| 9,791,238 | B2 * | 10/2017 | Bowen | F41C 23/04 |
| 9,829,272 | B2 | 11/2017 | Brown | |
| 9,927,207 | B1 | 3/2018 | Haugland | |
| 9,933,232 | B2 | 4/2018 | Gilmer | |
| D824,476 | S | 7/2018 | Bosco et al. | |
| 10,054,393 | B2 | 8/2018 | Kedairy | |
| 10,180,302 | B2 | 1/2019 | Reavis, III | |
| D846,685 | S | 4/2019 | Ewer | |
| D847,932 | S | 5/2019 | Reavis, III | |
| D852,309 | S | 6/2019 | Al-Khateeb | |
| D854,110 | S | 7/2019 | Reavis, III | |
| 10,345,060 | B2 * | 7/2019 | Irvin | F41C 23/14 |
| 2017/0082394 | A1 * | 3/2017 | Chow | F41C 23/06 |
| 2021/0018296 | A1 * | 1/2021 | Faifer | F41C 23/14 |

OTHER PUBLICATIONS

Gear Head Works, "Tailhook Mod 2 Black", Known to exist as early as Sep. 13, 2019, Publisher: Retrieved from https://gearheadworks.com/product/tailhook-mod-2-black/.

Gear Head Works, "MP5K Tailhook Mounting Arm", Known to exist as early as Sep. 25, 2019, p. 2, Publisher: Retrieved from https://gearheadworks.com/product/mp5k-tailhook-mounting-arm/.

Gear Head Works, "What is Tailhook: Mod1, Mod 2", Known to exist as early as Sep. 25, 2019, p. 2, Publisher: Retrieved from https://gearheadworks.com/tailhook/.

Kak Industry LLC, "Kak Shockwave 2.0 Blade and Tube-FDE", Known to exist as early as Sep. 25, 2019, p. 2, Publisher: Retrieved from https://www.kakindustry.com/kak-shockwave-2-0-blade-and-tube-fde.

Kak Industry LLC, "Shockwave Blade Pistol Stabilizer—Black", Known to exist as early as Sep. 25, 2019, p. 2, Publisher: Retrieved from https://www.kakindustry.com/shockwave/shockwave-black.

Maxim Defense, "JP Silent Captured Spring—Heavy", Known to exist as early as Sep. 13, 2019, Publisher: Retrieved from https://www.maximdefense.com/buffer-system/silent-captured-spring-heavy/.

Maxim Defense, "SCW Stock", Known to exist as early as Sep. 13, 2019, Publisher: Retrieved from https://www.maximdefense.com/product/scw-stock/.

Maxim Defense, "PDX", Known to exist as early as Sep. 13, 2019, Publisher: Retrieved from https://www.maximdefense.com/product/pdx/.

Pistol Mounted Solutions, "Pistol Mounted Solutions", Known to exist as early as Sep. 25, 2019, p. 2, Publisher: Retrieved from https://pistolmountedsolutions.com/.

SB Tactical, "SB-Mini", Known to exist as early as Sep. 13, 2019, Publisher: Retrieved from https://www.sb-tactical.com/product/sb-mini/.

SB Tactical, "Pistol Stabilizing Braces—SBA3", Known to exist as early as Sep. 25, 2019, p. 2, Publisher: Retrieved from https://www.sb-tactical.com/product/sba3/.

SB Tactical, "Pistol Stabilizing Braces—SBPDW", Known to exist as early as Sep. 25, 2019, p. 2, Publisher: Retrieved from https://www.sb-tactical.com/product/sbpdw/.

SB Tactical, "SBM4", Known to exist as early as Sep. 13, 2019, Publisher: Retrieved from https://www.sb-tactical.com/product/sbm4/.

Shockwave Technologies, "Blade 2K With Tube All Colors", Known to exist as early as Aug. 7, 2019, p. 6, Publisher: Retrieved from https://shockwavetechnologies.com/product/black-shockwave-blade-2-0-pistol-stabilizer/.

Midway USA, "Sig Sauer SBX Pistol Stabilizing Brace AR-15", Known to exist as early as Sep. 13, 2019, Publisher: Retrieved from https://www.midwayusa.com/product/2139538448.

Sig Sauer, "Sig Sauer Folding PCB Kit—MPX, MCX—Black", Known to exist as early as Sep. 25, 2019, p. 3, Publisher: Retrieved from https://www.sigsauer.com/store/sig-sauer-folding-pcb-kit-mpx-mcx-black.html.

SB Tactical, "MPX PSB", Known to exist as early as Sep. 13, 2019, Publisher: Retrieved from https://www.sb-tactical.com/product/mpx-psb/.

Double Star Corp., "Strongarm Pistol Brace", Known to exist as early as Mar. 9, 2019, p. 2, Publisher: Retrieved from https://web.archive.org/web/20190309040629/https://star15.com/strongarmtm-pistol-brace.

Strike Industries, "AR Pistol Stabilizer", Known to exist as early as Sep. 13, 2019, p. 2, Publisher: Retrieved from https://www.strikeindustries.com/shop/products/ar/compliance-solutions/si-stab-arp.html.

Strike Industries, "Strike Industries MPX/MCX Stabilizer", Known to exist as early as Sep. 13, 2019, Publisher: Retrieved from https://www.strikeindustries.com/shop/products/ar/compliance-solutions/si-stab-mpx.html.

Strike Industries, "PDW Stabilizer", Known to exist as early as Sep. 13, 2019, p. 2, Publisher: Retrieved from https://www.strikeindustries.com/shop/products/ar/compliance-solutions/si-stab-pdw.html.

Tactical-Life, "The New Doublestar Strongarm Pistol Stabilizing Brace Sold out Fast", Mar. 14, 2018, p. 3, Publisher: Retrieved from https://www.tactical-life.com/gear/accessories/doublestar-strongamn-pistol-brace/.

Thordsen Customs, LLC, "Cheek Rest Kits", Known to exist as early as Sep. 25, 2019I, p. 1, Publisher: Retrieved from https://www.thordsencustoms.com/ar-pistol/cheek-rest-kits.htm.

* cited by examiner

FIREARM STOCK OR ARM BRACE

CLAIM OF PRIORITY UNDER 35 U.S.C. § 119

The present Application for Patent claims priority to Provisional Application No. 62/960,620 entitled "Firearm Arm Brace" filed Jan. 13, 2020, and assigned to the assignee hereof and hereby expressly incorporated by reference herein.

FIELD OF THE DISCLOSURE

The present disclosure relates generally to firearms. In particular, but not by way of limitation, the present disclosure relates to systems, methods and apparatuses for a stock or arm brace configured for coupling to a firearm.

DESCRIPTION OF RELATED ART

Certain firearms, such as rifles, are commonly used with buttstocks or shoulder stocks to provide force distribution and stability while firing. Some buffer tubes or receiver extensions can include adjustment features to allow a user to adjust a length of pull. Although fixed buffer tubes are sometimes used, this disclosure refers to adjustable buffer tubes or receiver extensions whenever these terms are used. Some adjustable buffer tubes or receiver extensions have multiple holes or recesses set into a slot in a bottom of the buffer tube or receiver extension. Adjustable stocks built to interoperate with these buffer tubes include a pin that can be selectively inserted into one of these holes to adjust the length of pull. Further depression of the pin can allow it to clear a lower edge of the slot and allow the stock to be removed from the buffer tube. In some cases, firearm stocks coupled to or attached to a buffer tube are accidentally detached from the receiver extension by users attempting to adjust the positioning of the firearm stock on the buffer tube.

SUMMARY OF THE DISCLOSURE

The following presents a simplified summary relating to one or more aspects and/or embodiments disclosed herein. As such, the following summary should not be considered an extensive overview relating to all contemplated aspects and/or embodiments, nor should the following summary be regarded to identify key or critical elements relating to all contemplated aspects and/or embodiments or to delineate the scope associated with any particular aspect and/or embodiment. Accordingly, the following summary has the sole purpose to present certain concepts relating to one or more aspects and/or embodiments relating to the mechanisms disclosed herein in a simplified form to precede the detailed description presented below.

Some embodiments of the disclosure may be characterized as a firearm stock including a body, a lower stock, a plunger, one or more buttons, and first and second concentric springs. The body can include a buffer tube aperture. The lower stock can extend below the body and can comprise a hollow cavity. The plunger can be slidingly arranged in the hollow cavity. The one or more buttons can be arranged on an outside of the hollow cavity and can be coupled to the plunger through elongated slots in walls of the hollow cavity. The first and second concentric springs can form a nested pair and can be arranged in the hollow cavity, wherein the first spring is taller than the second spring. Depressing the plunger up to a first distance compresses the first spring and depressing the plunger past the first distance compresses the first and second springs.

Other embodiments of the disclosure may also be characterized as a firearm including a barrel, a receiver coupled to the barrel, a buffer tube coupled to the receiver, and a stock coupled to the buffer tube. The stock can include a body, a lower stock, a plunger, one or more buttons, and first and second concentric springs. The body can include a buffer tube aperture. The lower stock can extend below the body and can comprise a hollow cavity. The plunger can be slidingly arranged in the hollow cavity. The one or more buttons can be arranged on an outside of the hollow cavity and can be coupled to the plunger through elongated slots in walls of the hollow cavity. The first and second concentric springs can form a nested pair and can be arranged in the hollow cavity, wherein the first spring is taller than the second spring. Depressing the plunger up to a first distance compresses the first spring and depressing the plunger past the first distance compresses the first and second springs.

Other embodiments of the disclosure can be characterized as a method of detaching a firearm stock from a buffer tube. The method can include depressing one or more buttons coupled to a plunger in a hollow cavity of the firearm stock, to compress one of two concentric springs in the hollow cavity, and thereby withdrawing the plunger from one of a plurality of lock holes in a bottom of the buffer tube. The method can also include sliding the firearm stock along the buffer tube. The method can also include releasing the one or more buttons to allow the plunger to enter a different one of the plurality of lock holes. The method can further include depressing the one or more buttons to compress both of the two concentric springs and thereby withdrawing the plunger from the different one of the plurality of lock holes in a bottom of the buffer tube. The method can yet further include sliding the firearm stock along the buffer tube to remove it, wherein the plunger is sufficiently depressed to clear a bottom of the buffer tube

BRIEF DESCRIPTION OF THE DRAWINGS

Various objects and advantages and a more complete understanding of the present disclosure are apparent and more readily appreciated by referring to the following detailed description and to the appended claims when taken in conjunction with the accompanying drawings:

DETAILED DESCRIPTION

The word "exemplary" is used herein to mean "serving as an example, instance, or illustration." Any embodiment described herein as "exemplary" is not necessarily to be construed as preferred or advantageous over other embodiments The present disclosure relates generally to firearm stocks or arm braces that support and stabilize a firearm, such as, but not limited to, an AR-15 or AR-15 pistol, with the user's shoulder (for a stock) or upper arm or forearm (for an arm brace). Although this disclosure applies to stocks and arm braces, the remainder of this disclosure will refer to stocks, though those of skill in the art will appreciate the equivalent applicability to arm braces. The stock can include a body, a lower stock, and can have an adjustable length of pull. The body includes a buffer tube receiving aperture and the lower stock includes a hollow cavity with a plunger and two concentric or nested springs therein. In some embodiments, the hollow cavity may span both the lower stock and the body, though the remainder of this disclosure will refer to situations where the lower stock comprises the hollow cavity. One or more buttons can be affixed to sides of the plunger through elongated slots in the hollow cavity that can be used to depress the plunger against the force of one or both of the springs. One of the two springs may be shorter than the other and have a greater spring constant than the longer spring. Depressing the plunger against the taller spring may allow a user to adjust the length of pull while greater pressure and engagement of the second spring allows the stock to be removed from a buffer tube or receiver extension. In some aspects, such a configuration utilizing two or more springs may prevent accidental removal of the firearm stock attached to the receiver extension due to the differing forces used to compress, for instance, an outer spring for position adjustment, and an inner spring for detachment.

Figure 1:
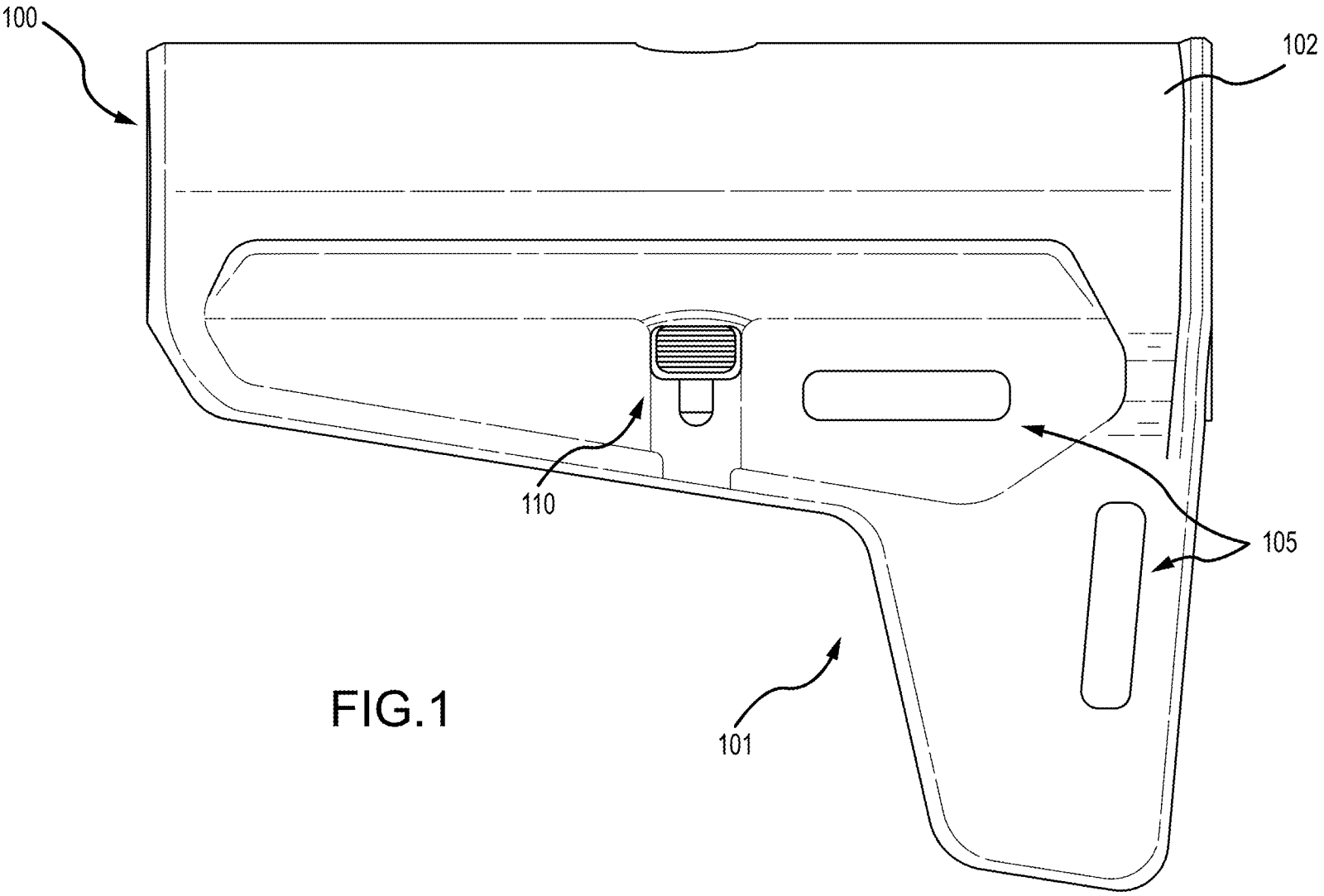
FIG. 1 is a side view of a firearm stock or arm brace according to an embodiment of the disclosure.

FIG. 1 illustrates a side view of a firearm stock 100 according to an embodiment of the present disclosure. In some examples, firearm stock 100 is configured to be coupled to a buffer tube or receiver extension of a firearm (not shown), such as a rifle, carbine, shotgun, or pistol (e.g., an AR-15 pistol), although other firearms and pistols may also be used in conjunction with the herein disclosed firearm stock 100. As shown, the firearm stock 100 includes a body 102 and a lower stock 101 extending down from the body 102. In some cases, the firearm stock 100 may also include one or more elongated slots 105 sized to accept a sling. The body 102 can be generally circular in cross section or have a tear-drop cross section as it eases down into the lower stock's 101 generally rectangular cross section. The body 102 can include a buffer tube aperture 322 (see FIGS. 3-4) shaped to have a similar if not the same cross section as a buffer tube or receiver extension of the firearm, and a diameter that is slightly larger than that of a standard buffer tube. This allows a buffer tube to be inserted into the buffer tube aperture 322 and slide within the buffer tube aperture 322 with minimal friction or catching on the sides. The buffer tube typically has a circular cross section with a rectangular region extending below the circular region. The buffer tube aperture 322 may also include a rectangular region at a bottom of the circular cross section shaped to receive the rectangular region of the buffer tube or receiver extension.

The lower stock 101 can include a hollow cavity (see 530 in FIG. 5) shaped to house two concentric or nested springs having different lengths and spring constants and compressed against a shelf of the hollow cavity via a plunger. One or more buttons can be affixed to the plunger through elongated slots in the hollow cavity walls enabling a user to depress the one or more buttons thereby depressing the plunger and allowing the user to adjust a length of pull of the stock 100 or remove the stock 100 from a buffer tube or receiver extension.

A user of the firearm stock 100 of the current embodiment may brace the stock 100 against his/her shoulder while aiming or firing. When implemented as an arm brace it may be designed to enhance the stability and accuracy of weapons limited to the use of one hand, such as pistols, and is not intended to be used as a shoulder stock. In some cases, the user may attach a sling to a quick detach (QD) socket 215 at the rear of the firearm stock 100, especially when implemented as an arm brace, and further illustrated and described in relation to FIGS. 2, 3, and 5. In some examples, the QD socket 215 may also be referred to as a QD cup. The lower stock 101 can take a variety of forms that provide a larger shoulder supporting region (i.e., buttpad) than would be possible with the body 102 alone such as, but not limited to the alternative shown in FIGS. 6-7.

Figure 2:
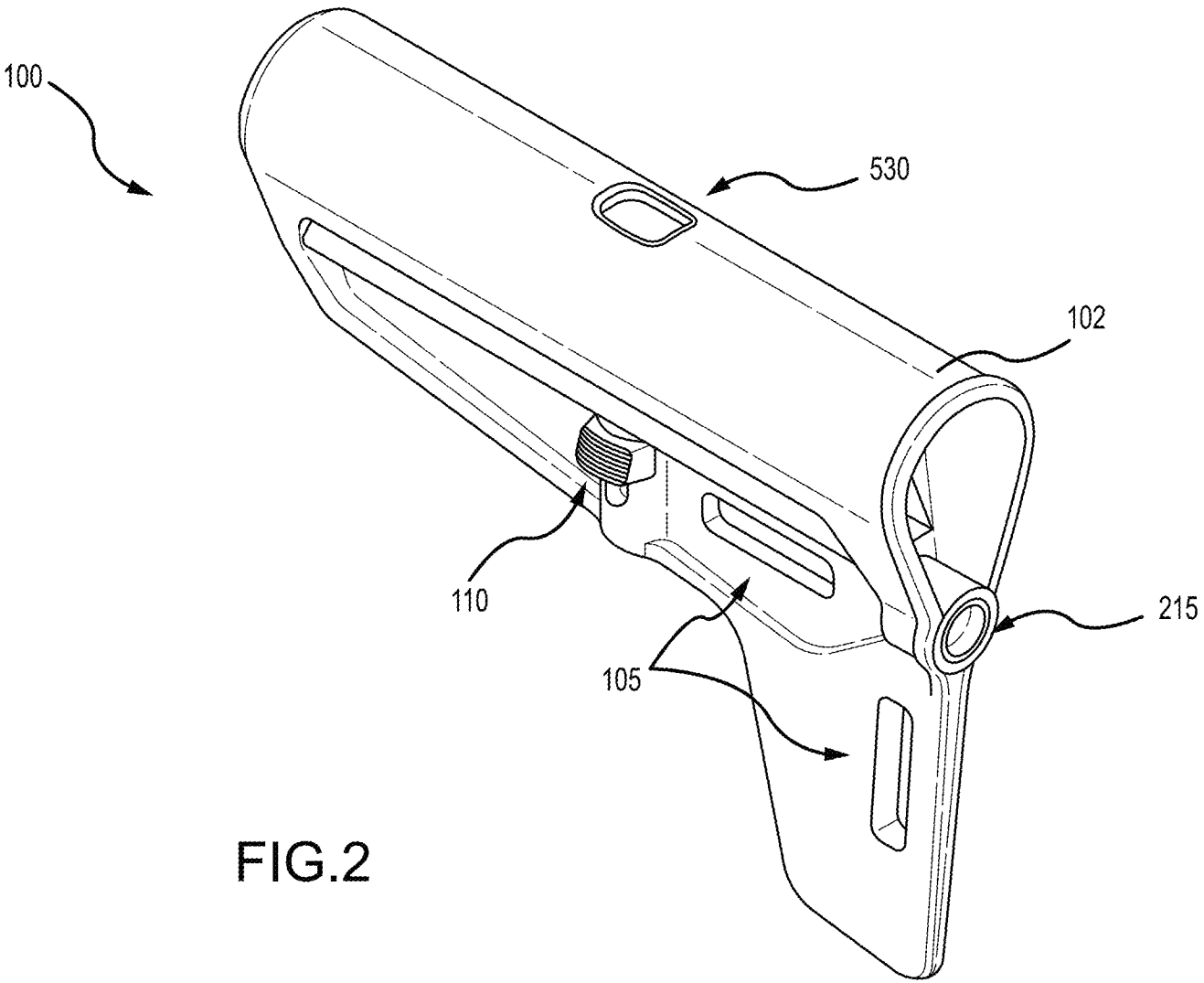
FIG. 2 is a top perspective view of a firearm stock or arm brace according to an embodiment of the disclosure.

FIG. 2 is a top perspective view of the firearm stock 100 of FIG. 1 according to an embodiment of the disclosure. In some cases, a sling swivel (e.g., push button sling swivel) may be utilized to provide a secure sling attachment point, allowing a sling to be quickly removed and installed on the firearm stock 100, where the sling swivel may be placed into the QD socket 215 on the firearm stock 100.

As depicted, the firearm stock 100 may comprise one or more buttons 110 on the left and right sides for depressing a plunger that can be moved between locking holes in a bottom of a buffer tube thereby adjusting the length between the rear end of the firearm stock 100 (i.e., end comprising the QD socket 215) and the trigger of the firearm to accommodate users with varying arm lengths (sometimes referred to as length of pull). In some cases, the firearm stock 100 may allow users to adjust the length of pull between multiple discrete adjustment positions (e.g., 4-position or 5-position adjustable). The firearm stock 100 may be designed to be mounted to the buffer tube or receiver extension of a firearm, such as an AR-15.

Figure 3:
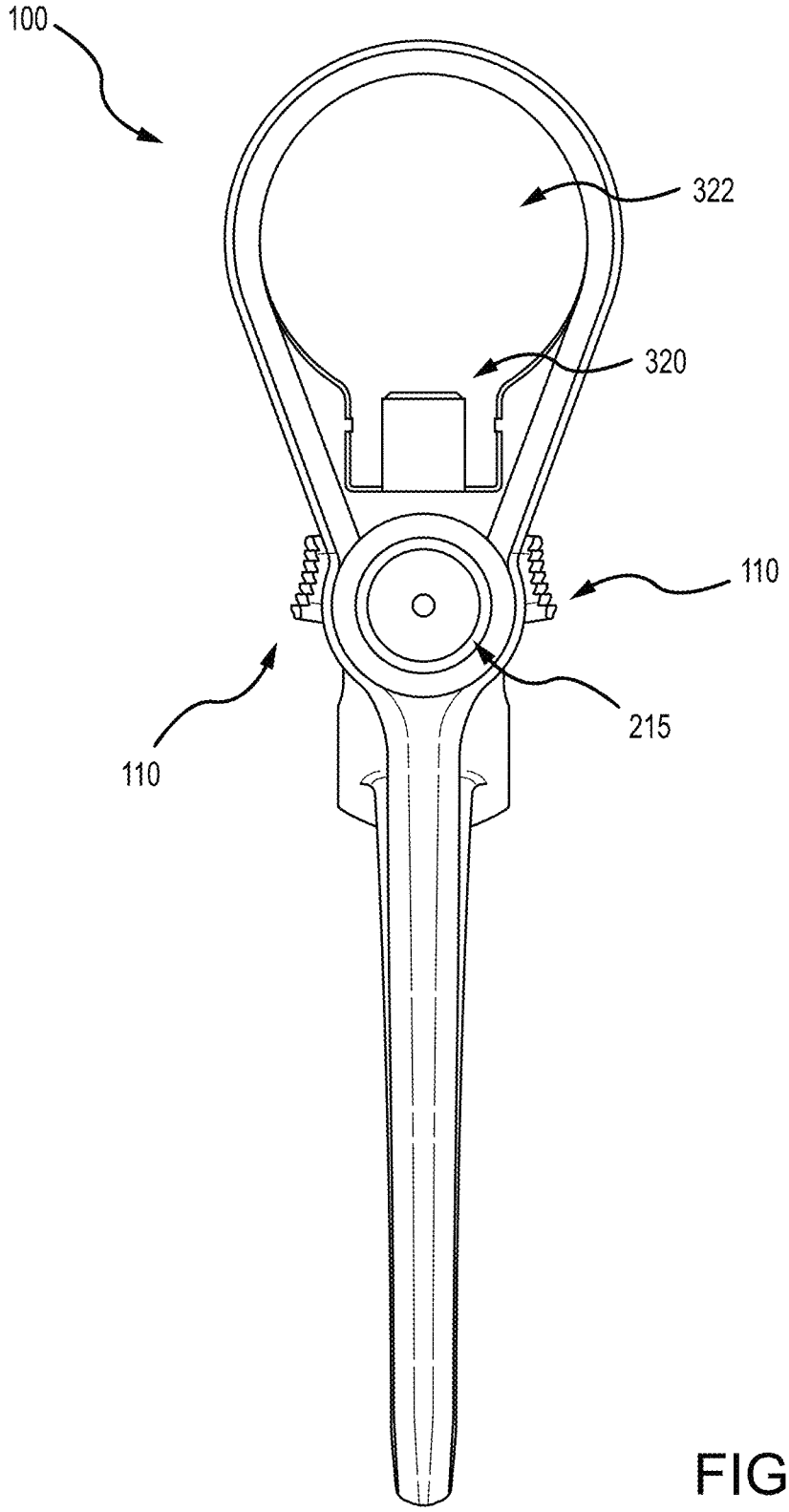
FIG. 3 is a rear view of a firearm stock or arm brace according to an embodiment of the disclosure.
Figure 4:
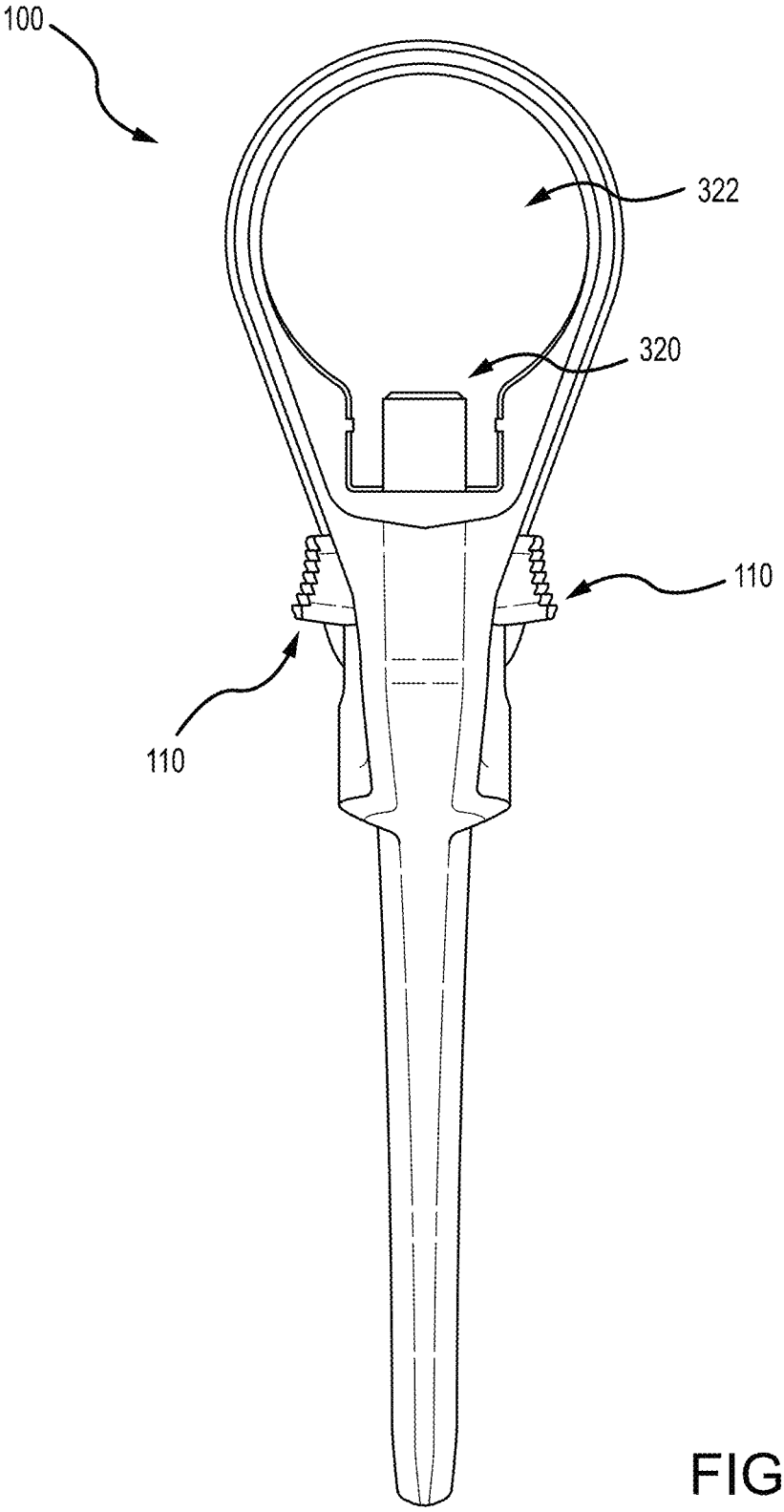
FIG. 4 is front view of a firearm stock or arm brace according to an embodiment of the disclosure.

FIG. 3 is a rear view of the firearm stock 100 of FIGS. 1 and 2 depicting a plunger 320, the QD socket 215, and the one or more buttons 110 on the sides of the stock 100, according to an embodiment of the disclosure. A top portion of the plunger 320 extends upward into the buffer tube aperture 322 to selectively engage locking holes in a bottom of the buffer tube or receiver extension (not shown). As one pulls down on either or both of the one or more buttons 110 the plunger 320 is pulled down in concert therewith, disengaging the plunger 320 from one of the locking holes and allowing the firearm stock 100 to slide along the buffer tube or receiver extension to adjust the length of pull. The plunger 320 may also be referred to as a locking plunger. FIG. 4 is a front view of the firearm stock 100 of FIGS. 1-3 depicting the plunger 320, the QD socket 215, and the one or more buttons 110 on the sides of the stock, according to an embodiment of the disclosure. In some cases, the buffer tube or the receiver extension may comprise one or locking holes for accepting the plunger 320, which may be located in an approximate middle of the firearm stock 100, although other locations along the longitudinal length of the firearm stock 100 are also possible.

Figure 5:
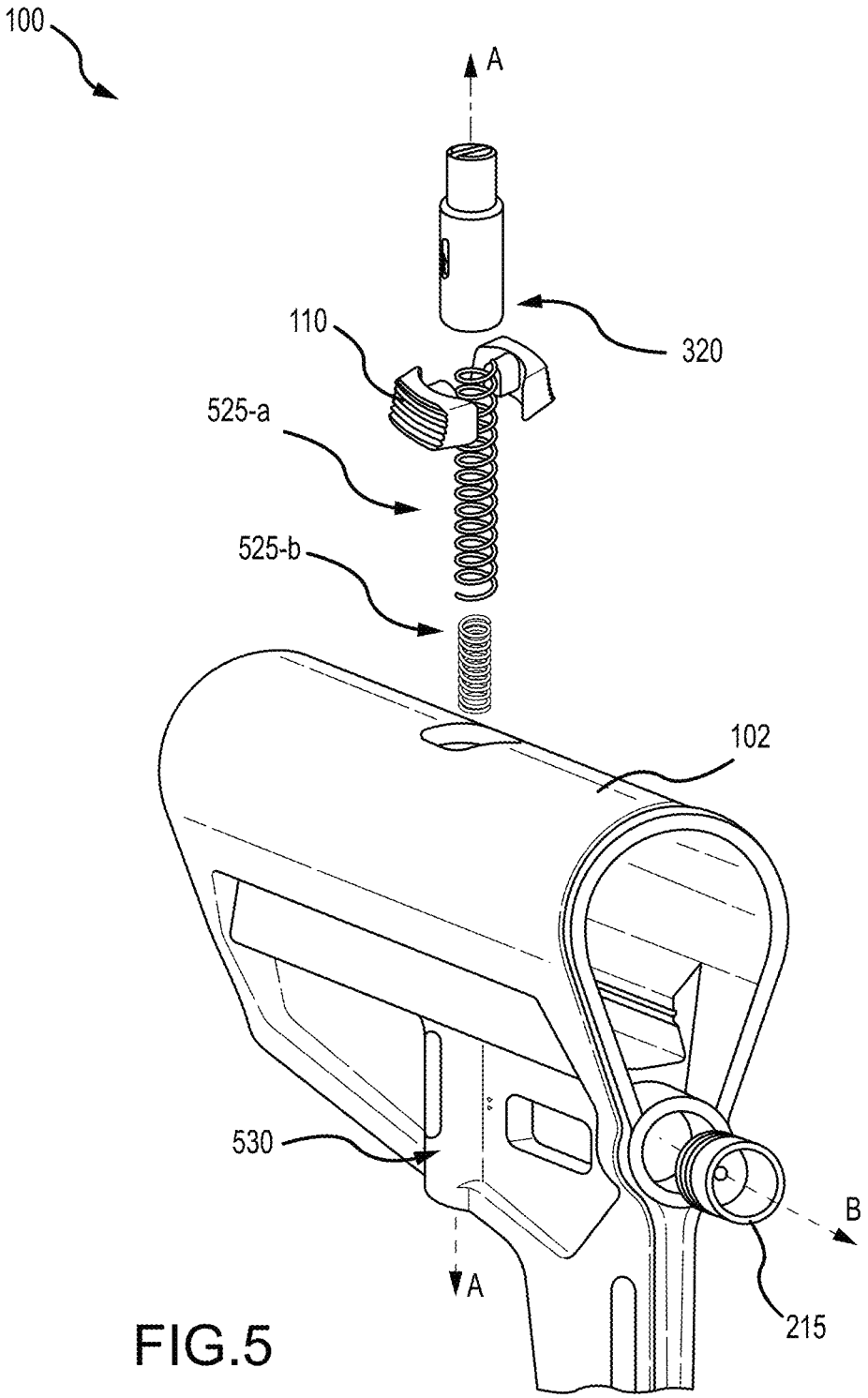
FIG. 5 is an exploded view of a firearm stock or arm brace according to an embodiment of the disclosure.

FIG. 5 is an exploded view of the firearm stock 100 of FIGS. 1-4 illustrating the plunger 320, the QD socket 215, the one or more buttons 110 coupled to the plunger 320 and extending through elongated slots in sides of a hollow cavity 530, and one or more concentric springs 525 (e.g., outer spring 525-*a*, inner spring 525-*b*) according to an embodiment of the disclosure. In some examples, concentric springs may also be referred to as nested springs or composite springs and may comprise two or more springs in parallel along an axis A (or both concentric to axis A). In some cases, and as illustrated, the coils of the two springs 525-*a* and 525-*b* may be wound in opposite directions to reduce the possibility of interference or binding. Concentric springs, as shown, may be utilized to change the overall stiffness of the spring system at a certain spring deflection (i.e., spring travel or spring compression). In other words, when the plunger 320 is depressed over a first range, the springs 525-*a* present a first spring constant, and past this point, over a second range, the springs 525-*a*, 525-*b* present a second spring constant greater than the first spring constant. Additionally or alternatively, concentric springs may be utilized to ensure the operation of a mechanism in the event that one spring breaks. As shown, the dual-spring mechanism comprises the longer outer spring 525-*a* and the shorter inner spring 525-*b*. Further, the bottom ends of the two springs 525-*a* and 525-*b* may be at the same vertical level, pressed against a shelf (not visible) within the hollow cavity 530, while the top end of the outer spring 525-*a* may be closer to the upper side of the firearm stock 100 than the top end of the inner spring 525-*b* (in other words, the outer spring 525-*a* can be taller than the inner spring 525-*b*). In some other embodiments, the inner spring 525-*b* may be selected to be longer than the outer spring 525-*a*. While depicted as a dual-spring system, the number of springs and relative lengths of springs may vary in different embodiments.

In some embodiments, the concentric springs may offer differing levels of resistance to movement of the plunger 320. For instance, when the one or more buttons 110 of the firearm stock 100 are pushed down, the plunger 320 may begin compressing a taller of the two springs 525. The force to compress a spring by a distance 'x' scales linearly with respect to that distance and a constant factor characteristic of the spring (i.e., its stiffness or spring constant, k). The longer of the two springs can have a smaller spring constant $k_1$ while the shorter of the two springs can have a larger spring constant $k_2$. The two springs in combination can have a third and even greater spring constant $k_3$.

In some examples, if the force applied on the buttons 110 is below a threshold, then the plunger 320 compresses the outer spring 525-*a* allowing the user to disengage the plunger 320 from the locking holes of the buffer tube or receiver extension and then adjust the length of pull. With application of pressure beyond the threshold, the plunger 320 may engage the inner spring 525-*b* and allow the plunger to clear the slot in a bottom of the buffer tube or receiver extension thereby allowing the stock 100 to be fully detached from buffer tube or receiver extension. In other words, it may take more than a threshold downward force to move the plunger 320 far enough downward to engage the inner or shorter spring 525-*b*.

As an example, a user of the firearm stock 100 may utilize the one or more buttons 110 on the sides of the stock to push the plunger 320 down in order to adjust the length of pull. In some cases, upon applying downward force to the button 110 (i.e., pressing down on the button), the plunger 320 may engage and compress one or more springs 525 located in a hollow cavity 530 of the lower stock. The hollow cavity 530 may be substantially vertically oriented and may be shaped to receive at least a portion of the plunger 320 (or locking plunger), and the dual-spring mechanism 525, and a portion of the one or more buttons 110. Further, after selecting the length of pull, the user may release the one or more buttons 110 allowing at least one of the springs (e.g., longer outer spring 525-*a*) to push the plunger 320 upward and back into engagement with one of the locking holes in a bottom of the buffer tube or receiver extension. A shelf (not shown) or other structure can be arranged within the hollow cavity 530 to support a bottom of the springs 525 and give them a structure to press against.

Additionally or alternatively, if the user pushes the buttons 110 further down until the amount of downward force exceeds the threshold, the plunger 320 may begin compressing the shorter inner spring 525-*b* of the firearm stock 100, allowing for detachment of the stock 100 from the firearm. For instance, after the inner spring 525-*b* starts to compress, the plunger 320 of the firearm stock 100 may clear the last groove or slot of the buffer tube of the receiver extension, allowing the user to detach the firearm stock from the buffer tube or receiver extension. In some cases, a slot surrounding the locking holes in a bottom of the buffer tube or receiver extension may be lower than the locking holes and thus greater depression of the plunger 320 allows clearance of a bottom edge of this slot. Accordingly, greater force than optimal for removing the stock 100 as compared to merely moving between length of pull positions (i.e., between locking holes). In some aspects, such a configuration utilizing two or more springs may prevent accidental removal of the firearm stock 100 attached to the receiver extension due to the differing forces used to compress, for instance, the outer spring 525-*a* for position adjustment, and the inner spring 525-*a* for detachment.

Figure 6:
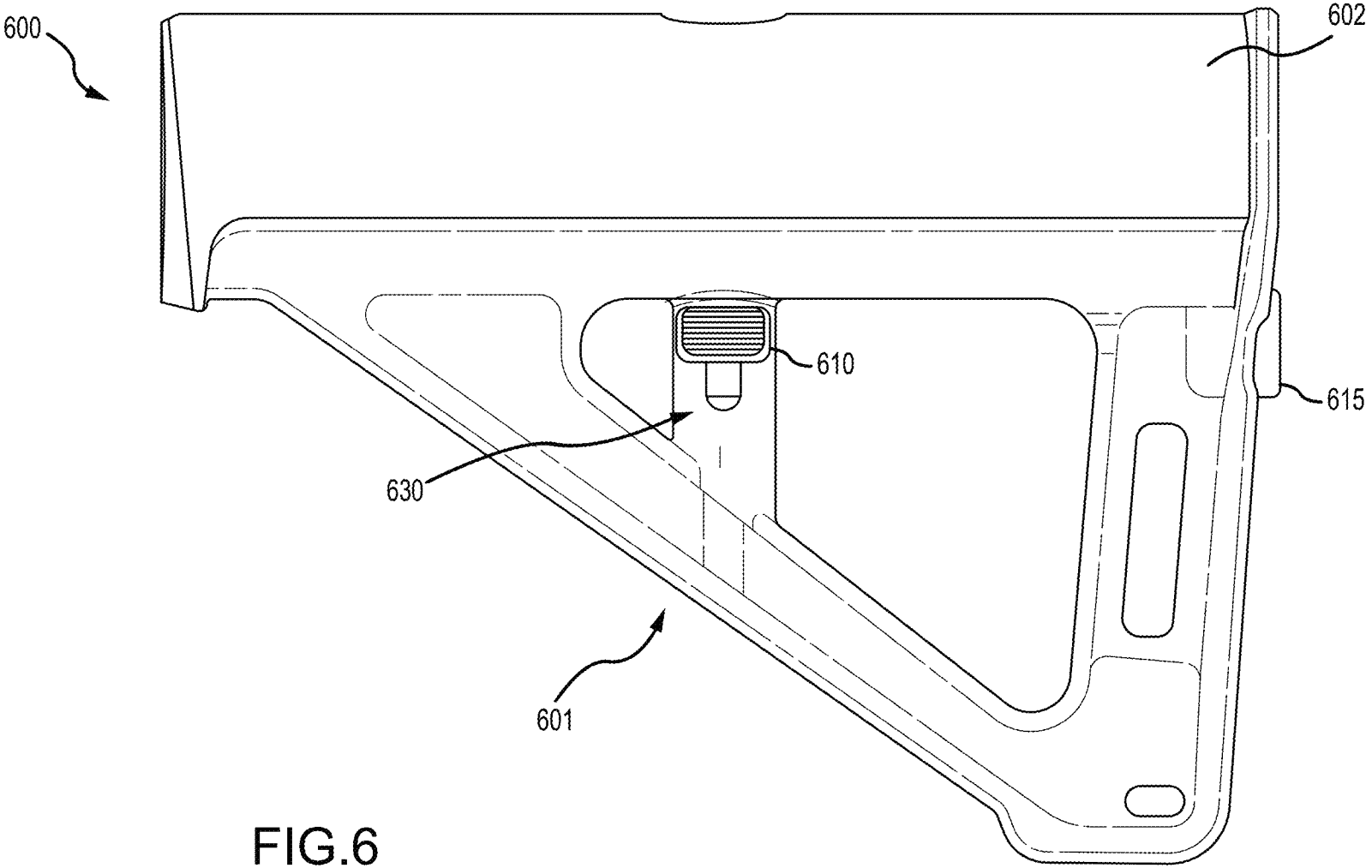
FIG. 6 is a side view of an alternate design of a firearm stock or arm brace according to an embodiment of the disclosure.

FIG. 6 is a side view of an alternate design of a firearm stock 600 according to an embodiment of the disclosure. In some examples, functioning of the buttons 610, dual-spring system, and plunger, as well as the shape and position of the dual-spring system, plunger, hollow cavity 630, and QD socket 615 of the firearm stock 600 may be similar or substantially similar to those described in relation to FIGS. 1-5. As seen, the shape of lower stock 601 and the positioning of the buttons 610 may vary for the firearm stock 600, as compared to that of the firearm stock 100. The lower stock 601 may be described as 'skeletonized' since areas of the lower stock 601 are cutaway to reduce weight. Portions of the lower stock 601 that outline this cutaway portion may have laterally-extending flanges that reinforce the lower stock 601 and provide similar strength to the non-skeletonized lower stock 101 of FIG. 1.

Figure 7:
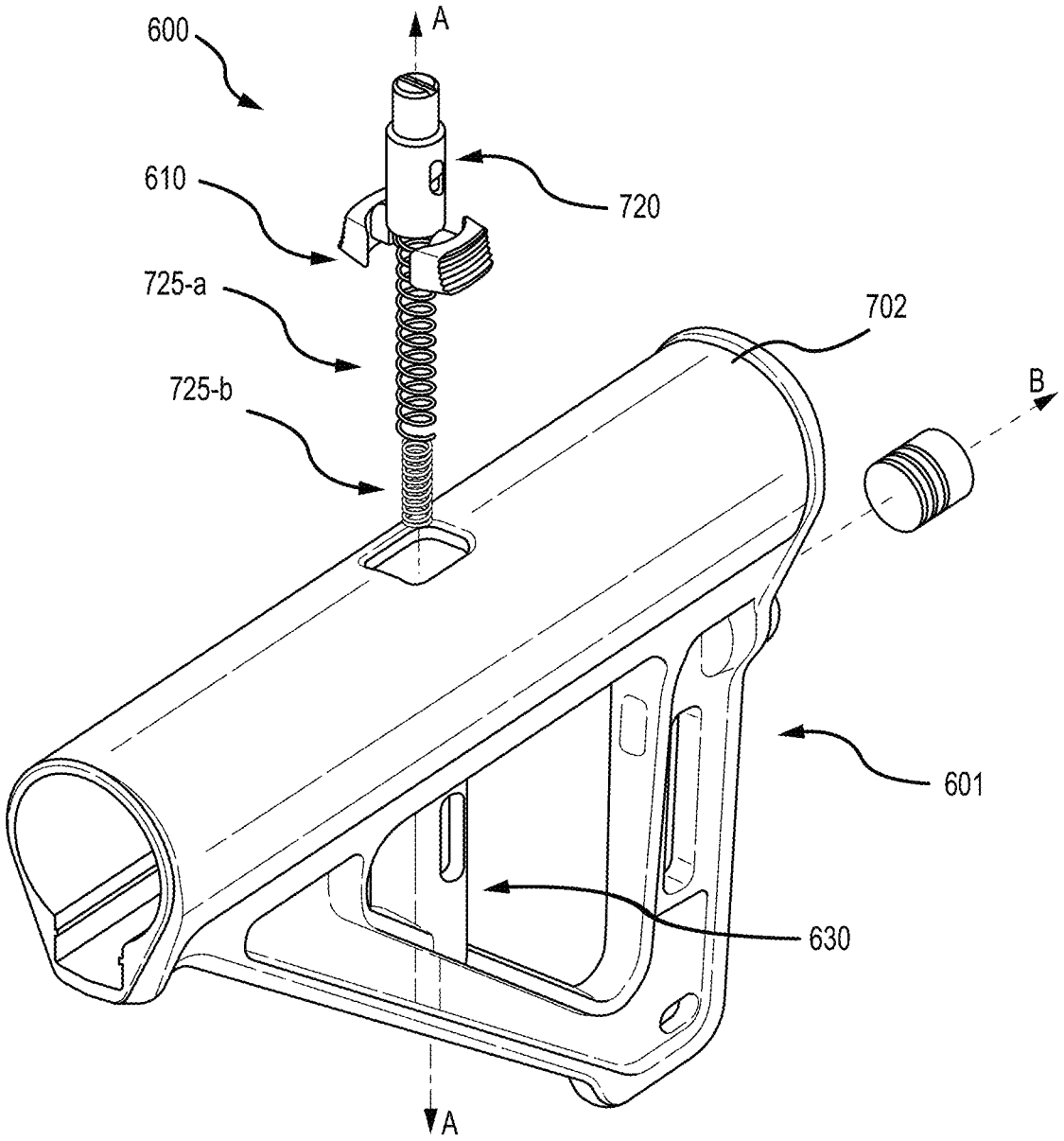
FIG. 7 is an exploded view of the firearm stock or arm brace of FIG. 6 according to an alternate embodiment of the disclosure.

FIG. 7 is an exploded view of the firearm stock 600 of FIG. 6 depicting a plunger 720, springs 725-*a* and 725-*b*, hollow cavity 630, and one or more buttons 610 on the sides of the stock 600, according to an alternate embodiment of the disclosure. As in the embodiment of FIGS. 1-5, the plunger 720, buttons 610, and springs 725 can be at least partially arranged within the hollow cavity 630 and can move up and down within the hollow cavity 630. The buttons 610 can pass through elongated slots in sides of the hollow cavity 630, these slots allowing the buttons 610 to move vertically along axis A. A pin or other elongated structure can couple the buttons 610 to each other through A shelf (not shown) can be arranged within the hollow cavity 630, a bottom of the springs 725 pressing against this shelf.

Figure 8:
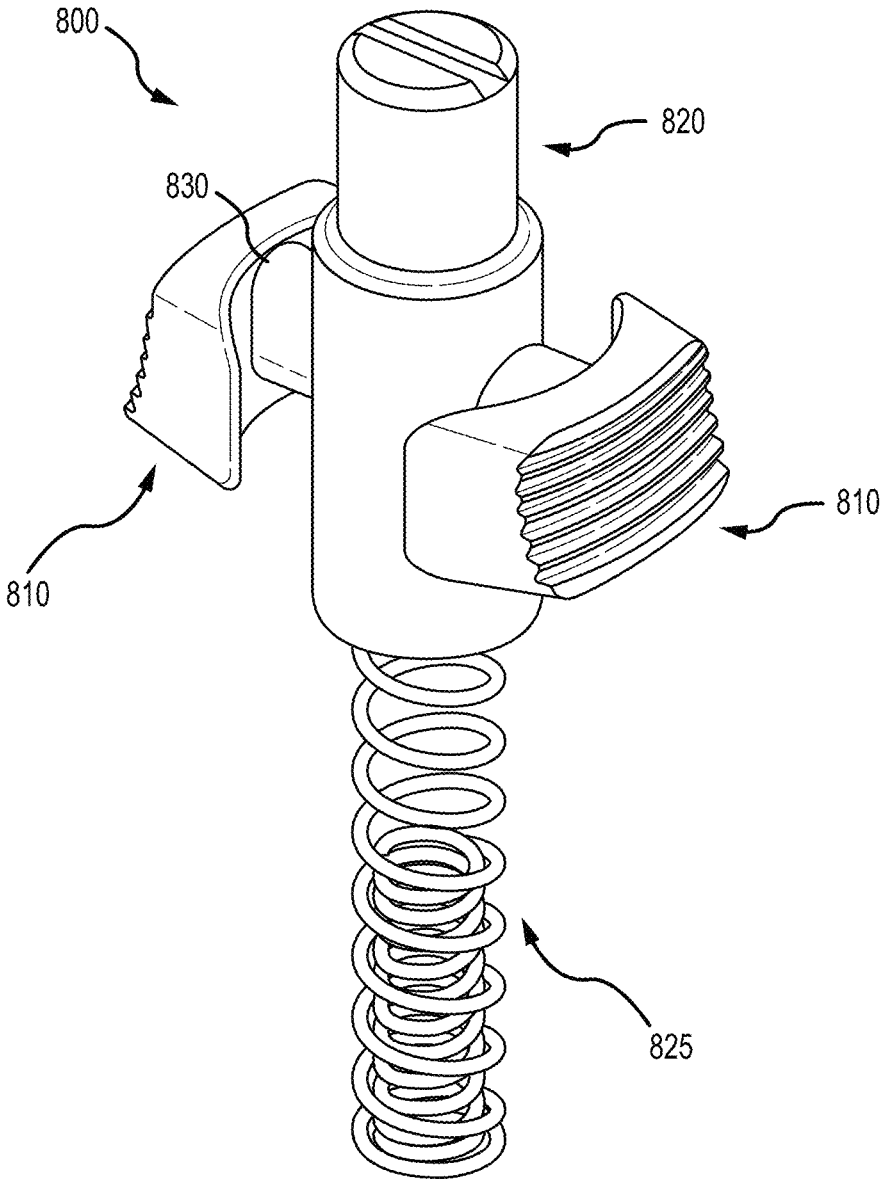
FIG. 8 is a detailed perspective view of the internal assembly of the firearm stock or arm brace according to an embodiment of the disclosure.

FIG. 8 is a detailed perspective view of an internal assembly 800 of the firearm stock 100 or 600, depicting a plunger 820, one or more concentric springs 825 (e.g., outer spring 825-*a*, inner spring 825-*b*), and one or more buttons 810 according to an embodiment of the disclosure. In some examples, the plunger 820, the one or more concentric springs 825, and the one or more buttons 810 may be examples of the plunger, springs, and buttons as described in either of FIG. 1-7. From this view one can see that the buttons 810 are coupled to the plunger 820 via arms 830, and these arms can be arranged within the elongated slots in the hollow cavity (e.g., 530 or 630) and coupled to the plunger and to each other via a pin or other elongated structure (not visible). Further, the plunger 820 can have two sections, an upper section with a first radius and a lower section with a second radius larger than the first radius. An upper edge of the lower section may impinge upon a narrower opening in the stock to prevent the plunger 800 from extending too far upward into the buffer tube aperture. The upper section can have a first height and the lower section can have a second height, greater than the first height. FIG. 8 shows the plunger 820 in an extended position where the outer spring 825-*a* contacts a bottom of the plunger. After some compression of the outer spring 825-*a*, the bottom of the plunger may contact and begin to compress the inner spring 825-*b* as shown in FIG. 9.

Figure 9:
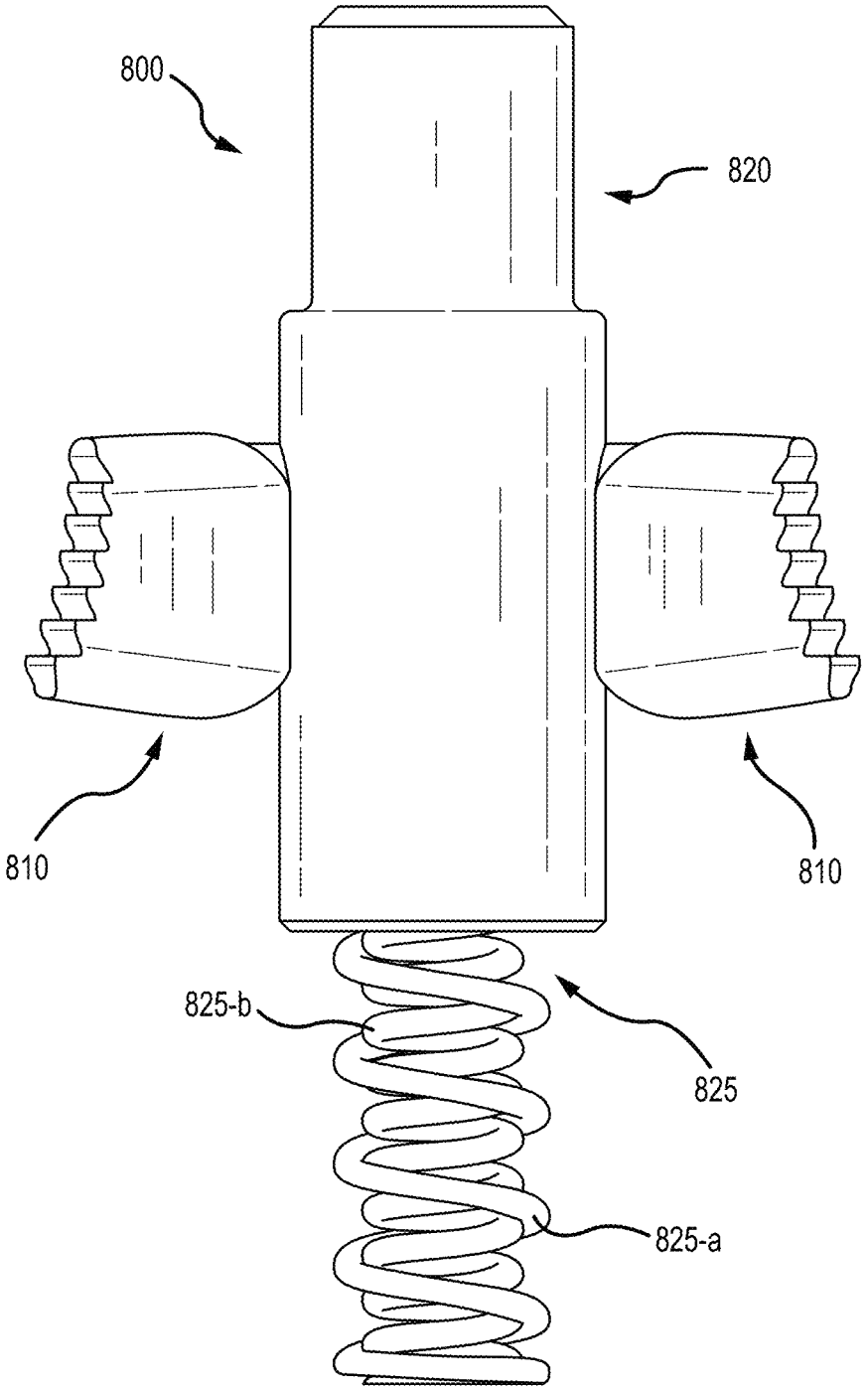
FIG. 9 is a detailed side view of the internal assembly of the firearm stock or arm brace according to an embodiment of the disclosure.

FIG. 9 is a detailed side view of the internal assembly 800 of FIG. 8 depicting the plunger 820, one or more concentric springs 825 (e.g., outer spring 825-*a*, inner spring 825-*b*), and one or more buttons 810 according to an embodiment of the disclosure.

Figure 10:
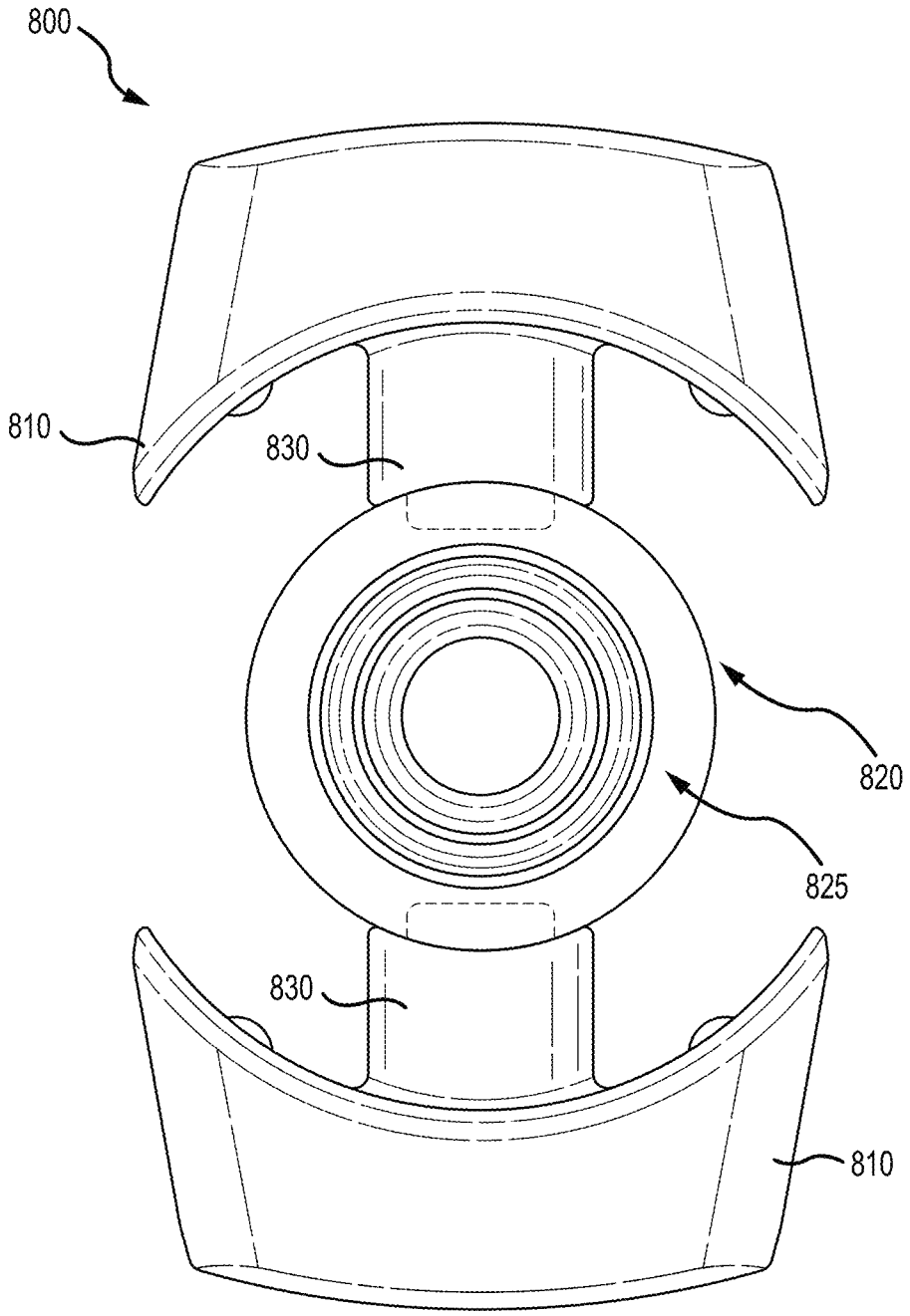
FIG. 10 is a detailed bottom view of the internal assembly of the firearm stock or arm brace according to an embodiment of the disclosure.

FIG. 10 is a detailed bottom view of the internal assembly 800 of the firearm stock according to an embodiment of the disclosure. Although not shown, a pin or other elongated structure can pass between the arms 830 through the plunger 820 to hold the buttons 810 to the plunger 820.

Figure 11:
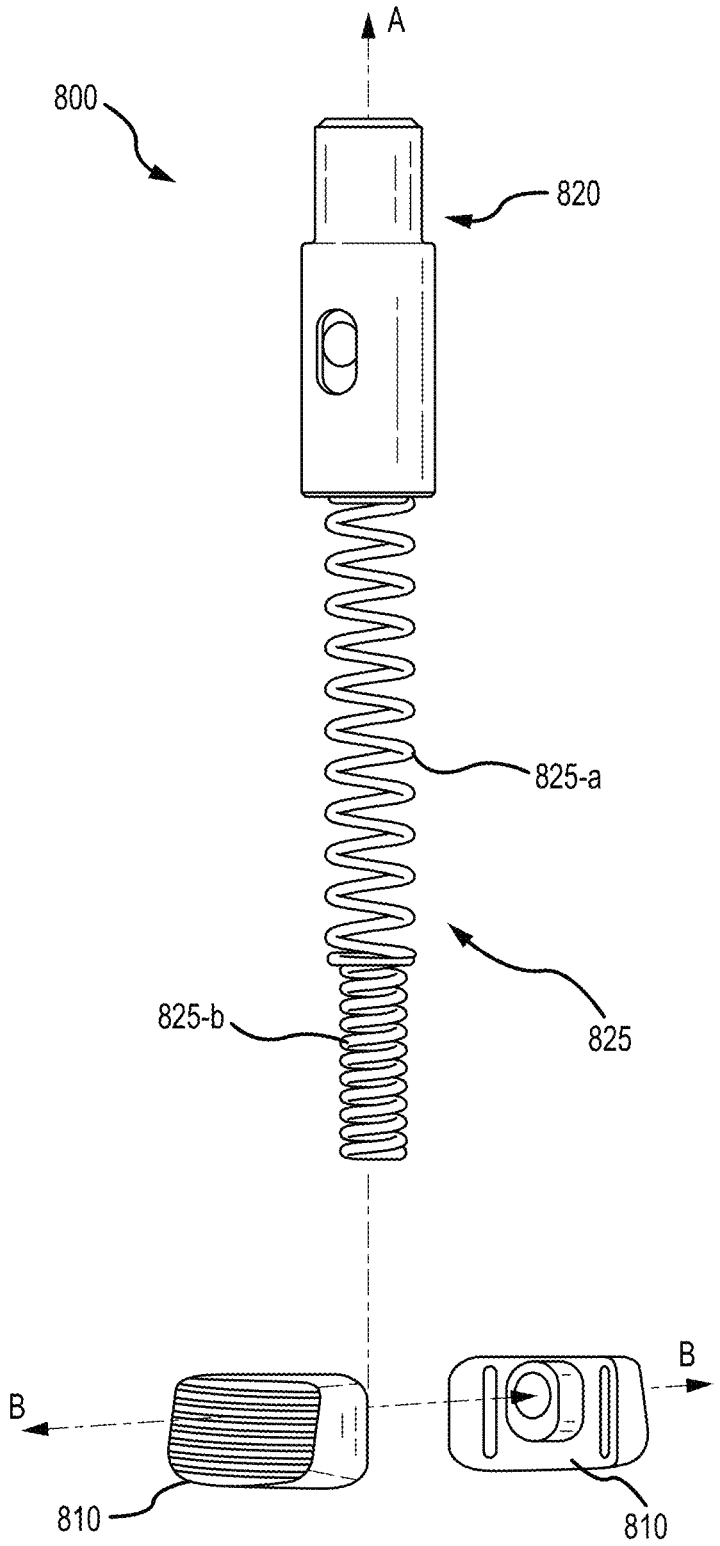
FIG. 11 is a detailed exploded view of the internal assembly of the firearm stock or arm brace, illustrating the inner and outer springs, the plunger, and the buttons (or levers), according to an embodiment of the disclosure.

FIG. 11 is a detailed exploded view of the internal assembly 800 of the firearm stock, illustrating the inner and outer springs 825-*b* and 825-*a*, respectively, the plunger 820, and the buttons 810, according to an embodiment of the disclosure. Although not shown, a pin or other elongated structure can pass between the buttons 810 through the plunger 820 to hold the buttons 810 to the plunger 820. Such a pin or other elongated structure may pass through the elongated slot shown in the plunger and the upper and lower portions of the plunger may be slidingly engaged in one embodiment such that the upper portion can recess somewhat into the lower portion (though this is not required).

Figure 12:
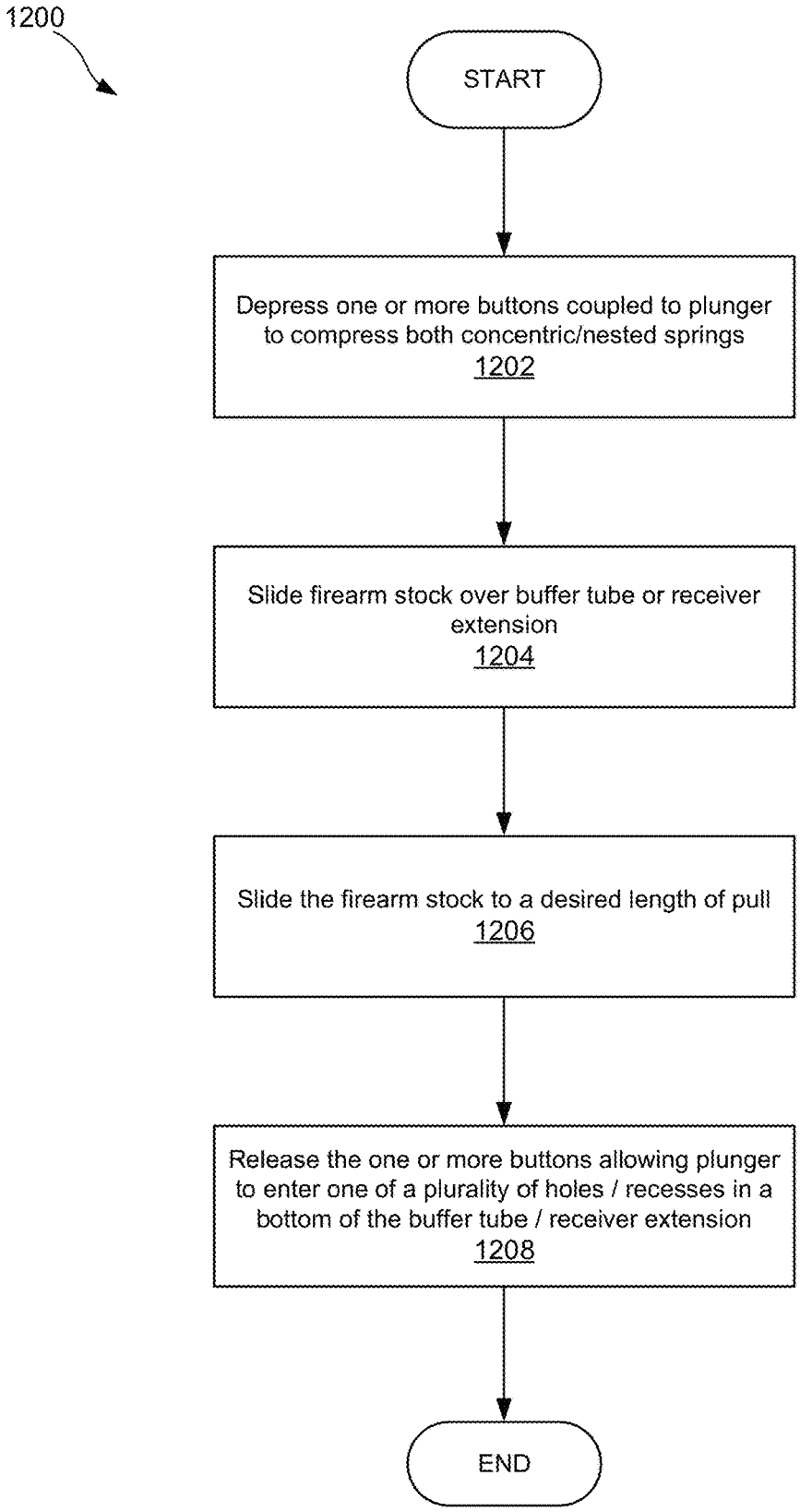
FIG. 12 illustrates a method of using an embodiment of the firearm stock or arm brace.

FIG. 12 illustrates a method of using an embodiment of the firearm stock. The method 1200 can include depressing one or more buttons coupled to a plunger in the firearm stock to compress both of a pair of concentric or nested springs pressing upward against a bottom of the plunger (Block 1202) and sliding the firearm stock over a buffer tube or receiver extension of a firearm (Block 1204) such as a rifle, carbine, shotgun, or pistol (e.g., an AR-15 pistol). The method 1200 can then include sliding the firearm stock to a desired length of pull (Block 1206) and releasing the one or more buttons, thereby allowing the plunger to move upward into one of a plurality of locking holes in a bottom of the buffer tube or receiver extension (Block 1208).

Figure 13:
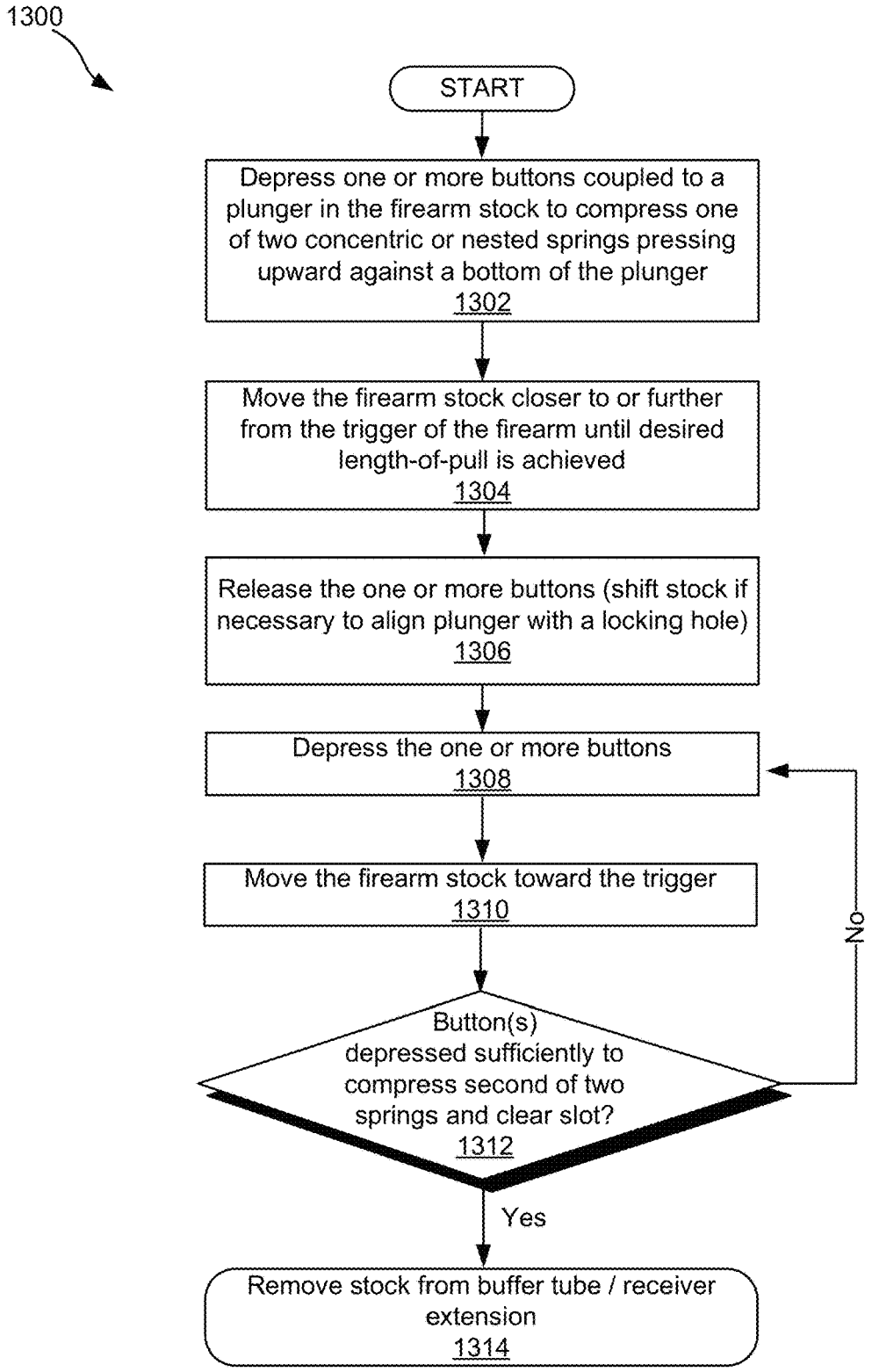
FIG. 13 illustrates a method of using an embodiment of the firearm stock or arm brace.

FIG. 13 illustrates a method of using an embodiment of the firearm stock. The method 1300 can include depressing one or more buttons coupled to a plunger in the firearm stock to compress one of two concentric or nested springs pressing upward against a bottom of the plunger (Block 1302). The spring being compressed can be an inner or outer of the two springs, and is a taller of the two springs. This action retracts the plunger from one of a plurality of locking holes in a bottom of a buffer tube or receiver extension. A user can then move the firearm stock closer to or further from the trigger of the firearm (Block 1304) until a desired length of pull is achieved. The user can then release the one or more buttons (Block 1306), which either causes the plunger to enter one of the plurality of locking holes, or causes the plunger to intercept a bottom of the buffer tube or receiver extension without entering one of the locking holes. In that case, the user can shift the firearm stock slightly until the plunger finds a nearby locking hole and is able to extend into the locking hole. At another time, the user can again depress the one or more buttons (Block 1308) and move the firearm stock toward the trigger (Block 1310). If the second spring is compressed, but insufficiently to allow the plunger to clear a bottom of the slot in the buffer tube (Decision 1312=No), then the user will be unable to remove the firearm stock from the buffer tube or receiver extension. On the other hand, if the one or more buttons are depressed sufficiently to compress the second of the two springs sufficiently for the plunger to clear a bottom of the slot (Decision 1312=Yes), then the user will be able to remove the firearm stock from the buffer tube or receiver extension (Block 1314). It should be appreciated that a user need not first adjust the length of pull (Blocks 1302-1306) before removing the stock from the buffer tube or receiver extension (Blocks 1308-1312). In other words, in an embodiment, the Blocks 1308-1312 may be practiced independent from other steps.

Figure 14:
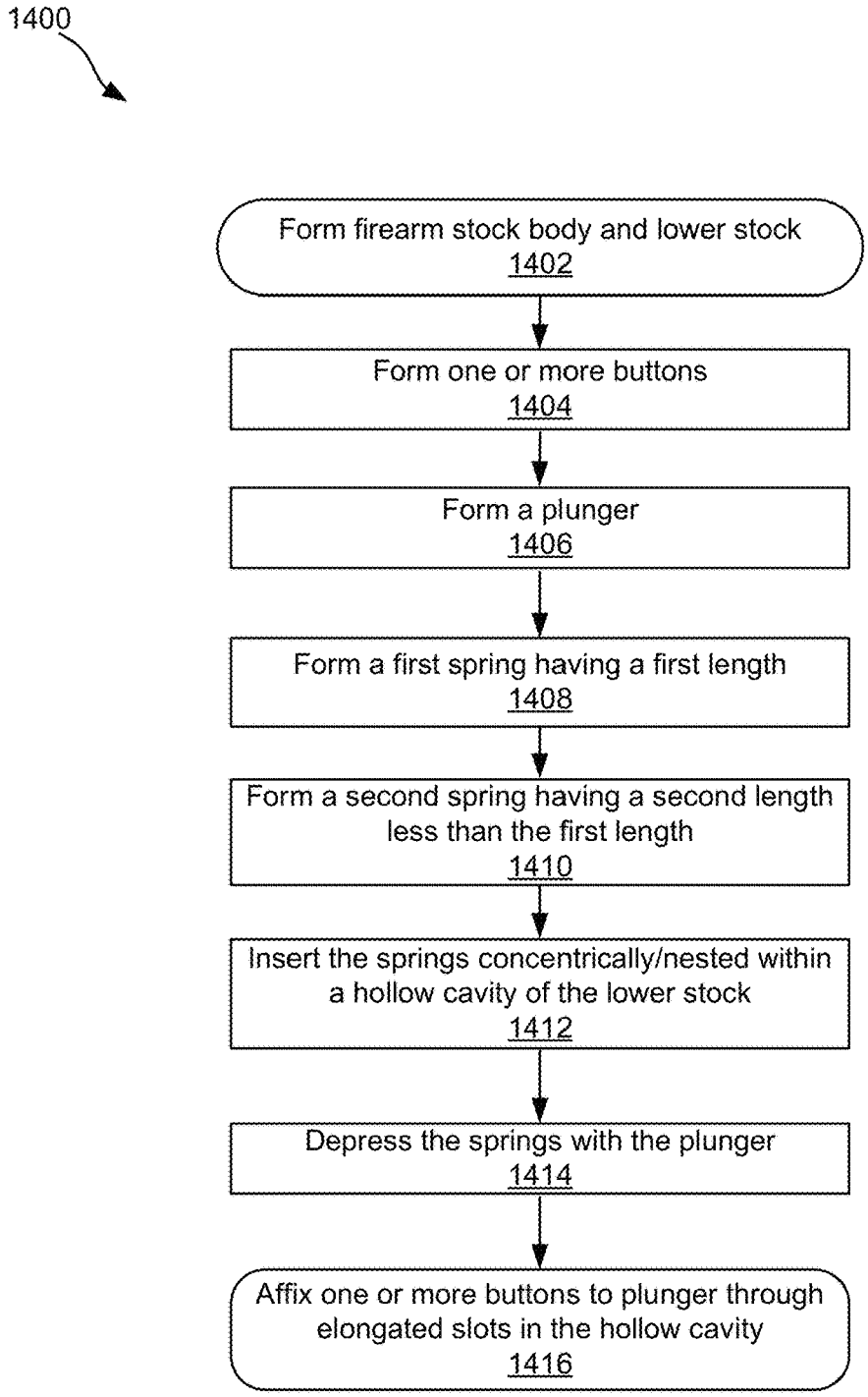
FIG. 14 illustrates a method of manufacturing an embodiment of the firearm stock or arm brace

FIG. 14 illustrates a method of manufacturing an embodiment of the firearm stock. The method 1400 includes forming a firearm stock body and lower stock (Block 1402), forming one or more buttons (Block 1404), forming a plunger (Block 1406), forming a first spring having a first length (Block 1408) and a second spring having a second length less than the first length (Block 1410), and inserting the first and second springs concentrically or in a nested fashion within a hollow cavity of a firearm stock (Block 1412), with the plunger pressing down on the first and taller of the two springs (Block 1414), and the one or more buttons affixed to the plunger and extending through elongated slots in the hollow cavity (Block 1416).

One of skill in the art will appreciate that firearms may not always be used or arranged in the same orientation, and thus the terms vertical, top, bottom, side, etc. may not always be accurate if one relies on a gravitational definition of up and down. However, those of skill in the art are well aware of the common and understood meanings of top and bottom and that a top of a firearm typically is where a scope or other sights are arranged, and a bottom is typically where the trigger and grip are arranged, though not always.

The terms and expressions employed herein are used as terms and expressions of description and not of limitation, and there is no intention, in the use of such terms and expressions, of excluding any equivalents of the features shown and described or portions thereof. Each of the various elements disclosed herein may be achieved in a variety of manners. This disclosure should be understood to encompass each such variation, be it a variation of an embodiment of any apparatus embodiment, a method or process embodiment, or even merely a variation of any element of these. Particularly, it should be understood that the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled.

As but one example, it should be understood that all action may be expressed as a means for taking that action or as an element which causes that action. Similarly, each physical element disclosed should be understood to encompass a disclosure of the action which that physical element facilitates. Regarding this last aspect, by way of example only, the disclosure of a "protrusion" should be understood to encompass disclosure of the act of "protruding"—whether explicitly discussed or not—and, conversely, were there only disclosure of the act of "protruding", such a disclosure should be understood to encompass disclosure of a "protrusion". Such changes and alternative terms are to be understood to be explicitly included in the description.

As used herein, the recitation of "at least one of A, B and C" is intended to mean "either A, B, C or any combination of A, B and C." The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. A firearm stock comprising:
a body comprising a buffer tube aperture;
a lower stock extending below the body and comprising a hollow cavity;
a plunger slidingly arranged in the hollow cavity;
one or more buttons arranged on an outside of the hollow cavity and coupled to the plunger through elongated slots in walls of the hollow cavity;
first and second concentric springs forming a nested pair and arranged in the hollow cavity, wherein the first spring is taller than the second spring, and wherein
depressing the plunger up to a first distance compresses the first spring, and
depressing the plunger past the first distance compresses the first spring and the second spring.

2. The firearm stock of claim 1, wherein the pair of nested springs are wound in opposing directions.

3. The firearm stock of claim 1, wherein depressing the plunger up to a first distance disengages the plunger from a locking hole in the buffer tube and allows adjustment of the length of pull.

4. The firearm stock of claim 1, wherein the first spring is arranged outside the second spring.

5. The firearm stock of claim 1, wherein the second spring is arranged outside the first spring.

6. The firearm stock of claim 1, wherein a quick-disconnect socket is arranged on a rear of the firearm stock.

7. A firearm comprising:
a barrel;
a receiver coupled to the barrel;
a buffer tube coupled to the receiver; and
a firearm stock selectively coupled to the buffer tube and comprising:
a body comprising a buffer tube aperture;
a lower stock extending below the body and comprising a hollow cavity;
a plunger slidingly arranged in the hollow cavity;
one or more buttons arranged on an outside of the hollow cavity and coupled to the plunger through elongated slots in walls of the hollow cavity;
first and second concentric springs forming a nested pair and arranged in the hollow cavity, wherein the first spring is taller than the second spring, and wherein
depressing the plunger up to a first distance compresses the first spring, and
depressing the plunger past the first distance compresses the first spring and the second spring.

8. The firearm of claim 7, wherein the pair of nested springs are wound in opposing directions.

9. The firearm of claim 7, wherein depressing the plunger up to a first distance disengages the plunger from a locking hole in the buffer tube and allows adjustment of a distance between the firearm stock and the receiver.

10. The firearm of claim 7, wherein the first spring is arranged outside the second spring.

11. The firearm of claim 7, wherein the second spring is arranged outside the first spring.

12. The firearm of claim 7, wherein a quick-disconnect socket is arranged on a rear of the firearm stock.

13. A method of detaching a firearm stock from a buffer tube comprising:
depressing one or more buttons coupled to a plunger in a hollow cavity of the firearm stock, to compress one of two concentric springs in the hollow cavity, and thereby withdrawing the plunger from one of a plurality of lock holes in a bottom of the buffer tube;
sliding the firearm stock along the buffer tube;
releasing the one or more buttons to allow the plunger to enter a different one of the plurality of lock holes;
depressing the one or more buttons to compress both of the two concentric springs and thereby withdrawing the plunger from the different one of the plurality of lock holes in a bottom of the buffer tube; and
sliding the firearm stock along the buffer tube to remove it, wherein the plunger is sufficiently depressed to clear a bottom of the buffer tube.

14. The method of claim 13, wherein the second spring has a greater spring constant than the first spring.

15. The method of claim 13, wherein the first spring is arranged around the second spring.

16. The method of claim 13, wherein second spring is arranged around the first spring.

17. The method of claim 13, wherein the pair of nested springs are wound in opposing directions.

18. The method of claim 13, further comprising attaching a sling to a quick disconnect socket on a rear of the firearm stock.

* * * * *